US005920029A

United States Patent [19]

Teaford

[11] Patent Number: 5,920,029

[45] Date of Patent: Jul. 6, 1999

[54] IGNITER ASSEMBLY AND METHOD

[75] Inventor: Richard L. Teaford, County of Campbell, Ky.

[73] Assignee: Emerson Electric Company, St. Louis, Mo.

[21] Appl. No.: 08/865,668

[22] Filed: May 30, 1997

[51] Int. Cl.[6] ..... F42B 3/18

[52] U.S. Cl. ..... 102/202.2; 102/202.5; 102/202.9; 102/531; 280/741; 361/248

[58] Field of Search ..... 102/202.1, 202.2, 102/202.3, 202.4, 202.5, 202.7, 202.8, 202.9, 202.14, 530, 531; 361/220, 247, 248, 120, 127, 56; 280/741

[56] References Cited

U.S. PATENT DOCUMENTS

| | | | |
|---|---|---|---|
| 2,377,804 | 6/1945 | Narvarte | 102/202.2 |
| 2,878,752 | 3/1959 | Johnson et al. | 102/202.4 |
| 3,181,464 | 5/1965 | Parker et al. | 102/202.7 |
| 3,288,068 | 11/1966 | Jefferson et al. | 102/202.7 |
| 3,333,538 | 8/1967 | Schnettler | 102/202.4 |
| 3,702,420 | 11/1972 | Cooper | 361/120 |
| 3,804,018 | 4/1974 | Janoski | 102/202.1 |
| 3,971,320 | 7/1976 | Lee | 102/28 R |
| 3,992,652 | 11/1976 | Blaisdell et al. | 361/120 |
| 4,040,356 | 8/1977 | Voreck, Jr. et al. | 102/202.7 |
| 4,210,799 | 7/1980 | Dzaack | 219/541 |
| 4,422,381 | 12/1983 | Barrett | 102/202.2 |
| 4,696,231 | 9/1987 | Bryan | 102/202.5 |
| 4,745,858 | 5/1988 | Harder | 102/202.2 |
| 5,054,395 | 10/1991 | Vetter et al. | 102/202.2 |
| 5,450,273 | 9/1995 | Boy | 361/129 |
| 5,596,163 | 1/1997 | Caflisch et al. | 102/202.2 |
| 5,616,881 | 4/1997 | Hansen | 102/202.4 |
| 5,639,986 | 6/1997 | Evans | 102/202.2 |
| 5,672,841 | 9/1997 | Monk et al. | 102/202.4 |
| 5,726,854 | 3/1998 | Maki et al. . | |
| 5,768,083 | 6/1998 | Maki et al. . | |
| 5,821,446 | 10/1998 | Chatley, Jr. | 102/202.7 |

FOREIGN PATENT DOCUMENTS

| | | | |
|---|---|---|---|
| 0745519A1 | 5/1995 | European Pat. Off. | B60R 21/26 |
| 0658739A2 | 6/1995 | European Pat. Off. | F42B 3/12 |
| 2122807 | 1/1984 | United Kingdom | 361/120 |

*Primary Examiner*—Harold J. Tudor
*Attorney, Agent, or Firm*—Polster, Lieder, Woodruff & Lucchesi

[57] ABSTRACT

An electrically conductive system including an apparatus and method wherein an electric current is sealingly passed through at least two spaced insulatively sealed zones with an insulatively sealed void space provided therebetween under a vacuum and serving as a discharge zone for possible inadvertent preignition brought about accidentally by outside external factors.

1 Claim, 2 Drawing Sheets

IGNITER ASSEMBLY AND METHOD

BACKGROUND OF THE INVENTION

The present invention is described in terms of an igniter assembly and method for igniting a pyrotechnic propellant and more particularly to an air bag inflator system for releasing gas at impact moment to timely inflate a personnel protective air bag, but its utilitity is not limited to that application.

A large number of air bag igniter devices of various types have been employed in the automobile industry to be capable in a matte of milliseconds to convert electrical energy into chemical energy rapidly to inflate protective air bags. These past devises for the most part have included comparatively complex, but not always satisfactory mechanisms to avoid premature and undesirable ignition. An early igniter assembly device, concerned with inadvertent energy releases is disclosed in U.S. Pat. No. 3,971,320, to J. T. M. Lee issued on Jul. 27, 1976, which employs a grounding shunt form a coaxial lead to the housing of an igniter to avoid against accidental firing. Such accidental firings, which can be brought about by changes in outside factors such as an electrostatic charge or radiant or electromagnetic energy or radio frequencies, could result in great harm to persons during the manufacturing process of ignitors or those otherwise meant to be protected by air bag equipment. To further insure against accidental firing, other comparatively complex, expensive and not always satisfactory arrangements have been employed. In this regard attention is directed to the two European patent publications: No. 0658739A2, inventor J. H. Evans, published on Jun. 21, 1995, which teaches an electrostatic spark gap discharge arrangement for two spaced electrodes outside a pyrotechnic cup on one side of a glass-to-metal seal with a bridge wire on the other side of the seal in intimate communication with a secondary pyrotechnic, and No. 745519A1, inventor, D. D. Hansen, published Dec. 9, 1996, which teaches a metal oxide varistor made of pressed powder for protecting the igniter from premature ignitions.

For the most part, past protective devices for preventing premature ignition of igniter assemblies have been comparatively complex in manufacture and assembly, expensive and not always efficient in operation, requiring comparatively complex manufacturing steps and additional parts in assembly.

The present invention provides a new and useful arrangement which is straightforward, and economical in manufacture and assembly, requiring a comparative minimum of parts and space and which optimizes the use of several parts which are also required for normal ignition performance, at the same time, avoiding inadvertent energy discharges often brought about in the past by electrostatic charges created by outside factors.

Various other features of the present invention will become obvious to one skilled in the art upon reading the disclosure set forth herein.

BRIEF SUMMARY OF THE INVENTION

More particularly, the present invention provides an electrically conductive assembly comprising: a housing shell of preselected material defining at least two internal chambers, upstream and downstream, each chamber including a defining peripheral wall with a preselected electrically insulatively sealing material extending transversely thereacross in sealed relation with the chamber-defining peripheral wall and with the insulative sealing material of one chamber being preselectively spaced from the insulative sealing material of the other chamber to provide an insulatively sealed void or partial vacuum chamber therebetween, and electrical conductors having a portion thereof extending in sealed relation through the electrically insulative sealing material of each chamber and the sealed void chamber therebetween with projecting upstream and downstream ends respectively. The insulatively sealed void chamber is made to serve to prevent possible undesirable preignition sparking. In addition, the present invention provides for a method of charging and discharging electrical energy through an electrically conductive conduit assembly extending in sealed relation through spaced first and second electrically insulatively sealed zones into an electric discharge zone with the space between the first and second insulatively sealed zones serving as a sealed void chamber accommodating isolated bleeding of high voltage electrostatic charges to prevent possible undesirable preignition sparking.

It is to be understood that various changes can be made by one skilled in the art in one or more of the several parts and in one or more of the several steps of the novel invention disclosed herein without departing from the scope or spirit of the present invention. For example, although the present invention as disclosed herein is usefuil with an igniter structure, particularly that used to inflate an air bag, the novel features of the present invention can be employed in a number of other electrical current carrying applications such as electrical switches, other explosive igniters and electric motors.

BRIEF DESCRIPTION OF THE SEVERAL VIEWS OF THE DRAWINGS

Referring to the drawings which disclose one advantageous embodiment of the present invention and a modification thereof.

DETAILED DESCRIPTION OF THE INVENTION

Figure 1:
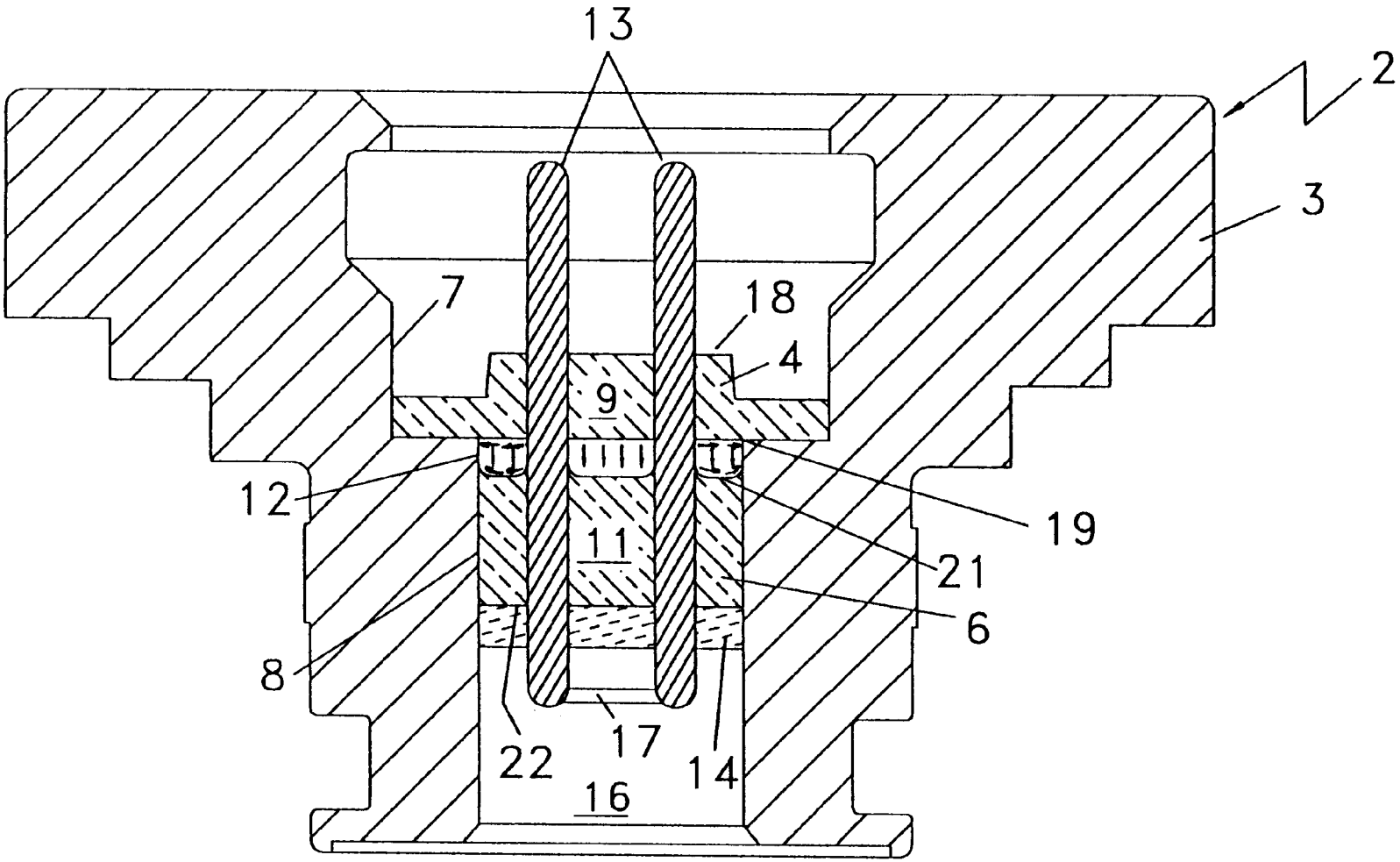
FIG. 1 is a cross-sectional view of an igniter header or collar incorporating one advantageous embodiment of the present invention, the arrows indicating a conductive flow path in accordance with a feature of the invention.

Referring to the drawings, and particularly FIG. 1 thereof, an igniter assembly 2 is disclosed which incorporates the novel features of the present invention and which can be particularly useful for igniting an explosive charge which, in turn, serves to inflate a protective air bag like those presently used as a safety device in the automobile industry.

It is to be understood that the inventive features of the novel system as described herein, which are principally useful to dissipate unwanted high voltage electrical charges which might be brought about by ambient or surrounding factors, are not to be considered as limited to use with air bags igniters but can be used in any one of a number of electricity conveying situations where it is desirable to dissipate stray electrical charges in a conductive system.

In FIG. 1, the disclosed igniter assembly 2, includes a housing shell or collar 3 4 which can be formed from any one of a number of suitable materials. It is here shown as being formed from a preselected, cold rolled steel to include three, internal, contiguous, cylindrical chambers which are axially aligned about the longitudinally extending central axis of housing 3. The first two chambers, namely an upstream chamber 4 and downstream chamber 6, each includes a defining peripheral wall 7 and 8, respectively, and each contains a preselected electrically insulating sealing material 9 and 1 1, respectively, extending transversely thereacross substantially normal to the longitudinal central axis of housing shell 2 in sealed relation with the chamber-defining peripheral walls 7 and 8, respectively. The sealing material 9 in the illustration embodiment shown, is a T seal, preformed in the shape shown and fused within a complimentarily shaped carbon cup. The seal 9, has an upper surface 18 and a lower surface 19, and passages transversely through it to accommodate terminal pins to which the sealing material 9 is fused. The sealing material 11 in the illustrative embodiment is also preformed as a cylindrical pellet, with an upper surface 21 and a lower surface 22 and transverse passages to accommodate the terminal pins to which the sealing material 11 is fused. In one advantageous embodiment of the present invention, the upstream sealing material 9 for upstream chamber 4 can be of a ceramic loaded fused sealing glass containing cobalt oxide, for example, and the sealing material 11 of the contiguous downstream chamber 6 can be of a preselected fused glass material which can be substantially similar in chemical composition to known glasses commonly used in the glass-to-metal sealing of hermetic terminal assemblies associated with refrigeration compressors, loaded with aluminum oxide, for example. In the illustration shown, the downstream face 19 of the upstream electrically insulated sealing material 9 of chamber 4 is spaced from the upstream face 21 of downstream electrically insulative sealing material 11 of down stream chamber 6 to provide a novel insulatively sealed void chamber 12 therebetween of preselected volume. It is to be noted that the volume of sealed void chamber 12 and the volume and chemistry of upstream and downstream insulative sealing materials 9 and 11 can be selectively varied by one skilled in the art in accordance with the requirement of a particular application and the results desired from the novel spacing arrangement forming the sealed void chamber 12. When the present invention is employed as an air bag igniter, advantageously the sealed void chamber has a volume of approximately zero point zero zero two six five cubic inches (0.00265 cu.in.) with a diameter of approximately zero point two six zero inches (0.260") and a thickness of approximately zero point zero five zero inches (0.050"). In accordance with the present invention, it is important that sealed void chamber 12 serve as an insulator at imposed established normal voltages and that chamber 12 be surface conductive at inadvertently imposed higher voltages which might be brought about by undesirable surrounding voltage creating factors, such as static electric charges, changing radiant energy, changing electromagnetic energy or changing radio frequencies. In the event of such occurrences and as can be seen in FIG. 1 of the drawings, the conductive currents move along the surfaces 19 and 21 of both upstream and downstream sealing materials 9 and 11 through sealed void chamber 12 to the steel shell 3, to be dissipated with insignificant consequence. Sealed void chamber 12 is in a partial vacuum condition to enhance dissipation of any unsolicited surrounding unwanted high voltages. This desired vacuum or partial pressure of sealed void chamber 12 is brought about when the upstream and downstream sealing materials 9 and 11 are first heated to fusing temperature and then cooled, gas trapped between them contracting to form a partial vacuum. The gas is that of the atmosphere of the furnace or oven in which the fusing takes place, preferably nitrogen, although a reducing gas may be used, particularly if the surface reduction transition metal oxides in the sealing glass is desired to produce a thin conductive film on the surfaces 18 and 19. In the latter case, arcing may take place outside the void space 12, but nevertheless at a place isolated from the explosive chamber. Traces of carbon monoxide from residual binder of the pelletized sealing materials along with methane, hydrogen and carbon dioxide may also be present if natural gas is used as the atmosphere in the furnace.

As can be seen in FIG. 1 of the drawings, the electrical conducting assembly as disclosed includes at least two electrically conductive terminal pins 13 which are disposed in preselectively spaced relation about the longitudinally extending central axis of the upstream and downstream contiguous insulated chambers 4 and 6. These electrically conductive pins 13 advantageously can be of fifty-two (52) alloy, nickel plated steel. It is to be understood, however, that the spacing, chemistry and number of such pins can vary in accordance with the usage and results desired. Spaced pins 13, which are substantially parallel to each other, are each in spaced relation from the chamber-defining peripheral walls 7 and 8 respectively with a central portion of each pin member 13 extending in glass sealed relation through the glass insulative sealing material 9 and 11 respectively of each upstream and downstream chamber 4 and 6 respectively and the sealed partial pressure or vacuum chamber 12 therebetween. The projecting ends of electrically conductive pins 13 serve as charging and discharging areas respectively and the insulatively sealed partial pressure chamber 12, as above described, permits arcing between the pins 13 and the steel shell 3 isolated from the explosive chamber 16 to prevent undesirable preignition sparking between pins 13.

As can be seen in FIG. 1 of the drawings, advantageously a preselected ceramic electrically insulating sealing material 14 can be provided, facing the downstream face 22 of insulating sealing material 11 with the spaced, electrically conductive pins 13 extending therethrough. As also can be seen in FIG. 1 of the drawings the downstream extremities of pins 13 terminate in a third internal contiguous axially aligned chamber 16, which, in the disclosed embodiment, can serve as an explosive charge air bag ignition chamber. The downstream pin extremities can have a suitable bridge wire or igniter circuit 17 (schematically shown) electrically connected thereto so as to be capable of igniting an explosive charge to be inserted in explosive chamber 16. If the chamber 16 is provided with a radially inwardly extending lip at its upper end, the axial thickness of the lip can help define the axial height of the void 12, the position of the pelletized seal 11 being determined by moving it into contact with the lip.

Figure 2:
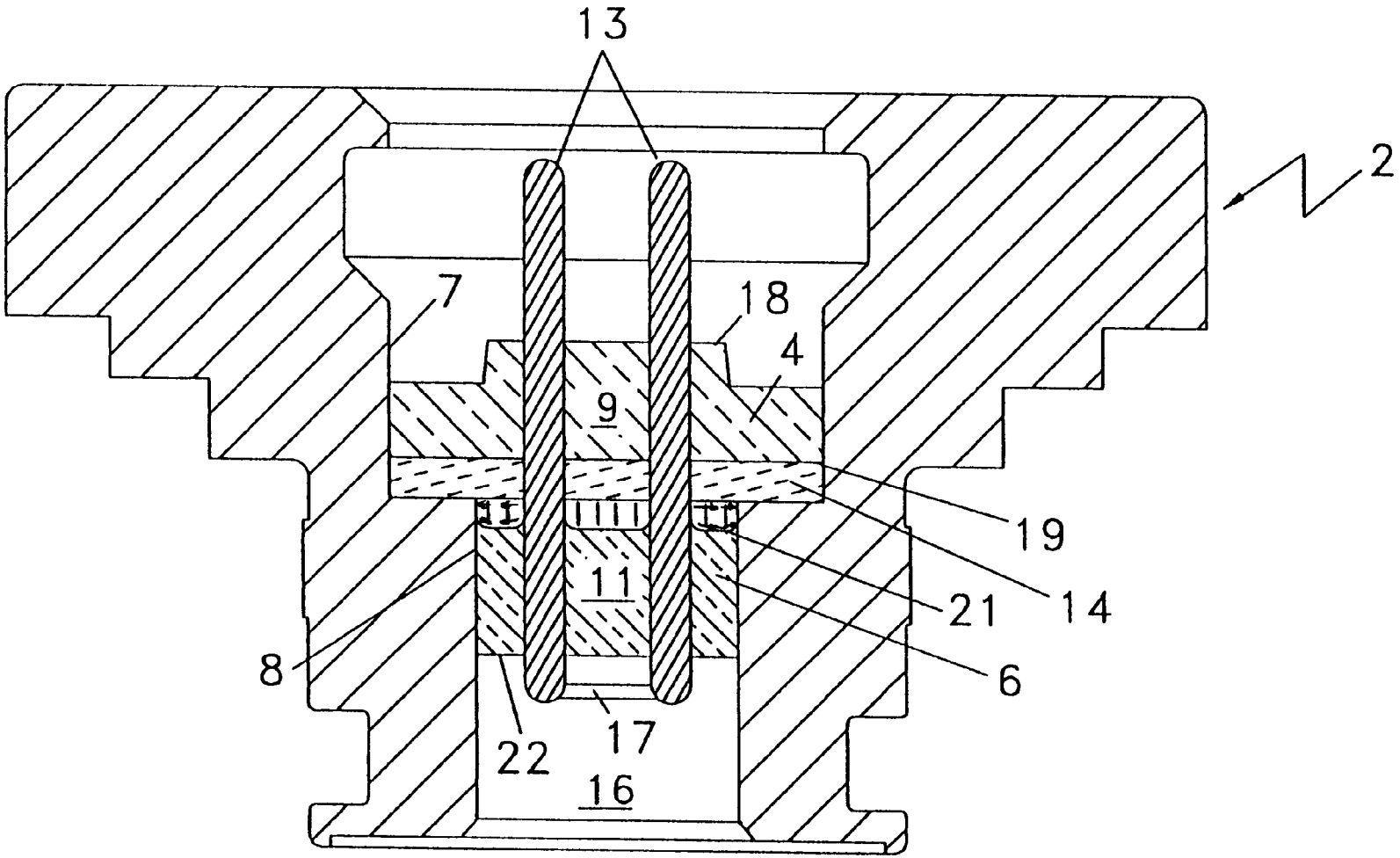
FIG. 2 is a cross-sectional view similar to that of FIG. 1, of an igniter header or collar incorporating modification in the positioning of an insulation layer to the header disclosed in FIG. 1.

Referring to FIG. 2 of the drawings, which discloses an igniter assembly, with most of the parts similar to those of the structure of FIG. 1, it can be seen that the preselected ceramic insulating material 14, alternatively, can be positioned downstream of the downstream face 19 of upstream insulative sealing material 9 in upstream chamber 4 rather than in downstream chamber 6 as shown in FIG. 1 of the drawings.

In accordance with the novel method of charging and discharging electric current as disclosed hereinabove, the electric current is passed from an electric charging zone from a source of current not here shown through an electrically conductive conduit assembly extending in sealed relation through spaced first and second sealed insulated zones with the space therebetween serving as a sealed void chamber to accommodate for possible undesirable preignition sparking in the electrically conductive conduit assembly.

The normal ignition voltage is of the magnitude of 9–12 volts DC, with a firing current of typically one point two (1.2) amps.

Transient static electric voltages are high, in the neighborhood of 1,000 to 25,000 volts with current greater than the one point two (1.2) amps for three (3) milliseconds required for ignition.

By loading the sealing material 11 with alumina, the sealing material retains its integrity sufficiently to enable the dimensions of the void chamber 12 to be held closely enough. Those dimensions are relatively flexible, the important thing is to provide a definite, partially evacuated space.

The chemistry of the seals and the entrapped gas is such as to make the breakdown voltage around 2000 volts. At 3,000–4,000 volt s, the spaced seals 9 and 11 will arc across their spaced surfaces. To insulate the ignition wire from these voltages it is desirable, in addition to the incorporation of void 12, to ensure that such arcing occurs across surfaces 19 or 21, and not at surface 22, and to that end, transition metal oxides in sealing material 9 can be utilized to produce a controlled surface conductive condition advantageously cobalt can be employed as the metal oxide.

I claim:

1. An air bag igniter assembly comprising: a housing shell formed from cold rolled steel to include three internal contiguous chambers axially aligned about a longitudinally extending central axis of said housing shell; each of said aligned chambers including a defining peripheral wall with the first two chambers serving respectively as upstream and downstream insulated chambers, each having a preselected glass electrical insulating sealing material extending transversely thereacross in sealed relation with said chamber-defining peripheral wall of said respective chamber with said sealing material of said upstream chamber being of ceramic loaded fused sealing glass and said sealing material of said contiguous downstream chamber being of preselected fused glass spaced from said ceramic loaded glass insulative sealing material of said upstream chamber to provide an insulatively sealed partial vacuum chamber therebetween of preselected approximate volume of zero point zero zero two six five (0.00265) cubic inches with a diameter of approximately zero point two six zero (0.260) inches and a thickness of approximately zero point zero five (0.05) inches forming a bridge thereacross with said insulative sealing glass on either side of said sealed partial vacuum chamber acting as an electrical insulator at imposed established normal operating voltages and being surface conductive at imposed higher voltages brought about inadvertently by surrounding voltage creative factors, gas in said insulatively sealed partial vacuum chamber during insulative sealing contracting during cooling of said glass sealing operations to form a partial vacuum in said insulatively sealed partial vacuum chamber; at least two electrically conductive pin members of fifty-two (52) alloy, nickel plated steel disposed in preselected spaced relation about said longitudinally extending central axis of said upstream and downstream glass insulatively sealed chambers and in preselected spaced relation from said chamber-defining peripheral walls with a central portion of each pin member extending in glass sealed relation through said glass insulative sealing material of each upstream and downstream chamber and the sealed partial vacuum chamber therebetween and with the extremities of said pins serving as charging and discharging extremities respectively and said insulating sealed partial vacuum chamber accommodating for undesirable preignition sparking between pins; said downstream face of said glass insulating material in said downstream chamber having a preselected ceramic insulating sealing material facing such downstream face with said main body of said spaced electrically conductive pins extending therethrough with the extremities of said pins terminating in said third internal contiguous aligned chamber which serves as an explosive charge air bag ignition chamber, said pin extremities having an igniter circuit electrically connected therebetween.

* * * * *